US008197285B2

(12) United States Patent
Farmer

(10) Patent No.: US 8,197,285 B2
(45) Date of Patent: Jun. 12, 2012

(54) METHODS AND APPARATUS FOR A GROUNDING GASKET

(75) Inventor: Daniel R. Farmer, Sahuarita, AZ (US)

(73) Assignee: Raytheon Company, Waltham, MA (US)

( * ) Notice: Subject to any disclaimer, the term of this patent is extended or adjusted under 35 U.S.C. 154(b) by 406 days.

(21) Appl. No.: 12/492,029

(22) Filed: Jun. 25, 2009

(65) Prior Publication Data

US 2010/0330827 A1 Dec. 30, 2010

(51) Int. Cl.
*H01R 13/648* (2006.01)

(52) U.S. Cl. ..... 439/607.35; 439/607.3; 439/927

(58) Field of Classification Search ..... 439/607.35, 439/607.3, 607.32, 607.4, 92, 108, 922, 939
See application file for complete search history.

(56) References Cited

U.S. PATENT DOCUMENTS 4,708,412 A * 11/1987 Himes et al. ..... 439/95
5,775,946 A * 7/1998 Briones ..... 439/607.25
5,807,137 A * 9/1998 Janota et al. ..... 439/607.33
5,947,769 A * 9/1999 Leonard et al. ..... 439/607.53
6,264,480 B1 * 7/2001 Nealis et al. ..... 439/92
6,666,720 B1 12/2003 Reisinger et al.

FOREIGN PATENT DOCUMENTS

WO 9856077 A1 12/1998
WO 2007079117 A1 7/2007

OTHER PUBLICATIONS

International Searching Authority, European Patent Office, "International Search Report," mailed Jul. 6, 2010; International Application No. PCT/US2010/030684, filed Apr. 12, 2010.

* cited by examiner

*Primary Examiner* — Xuong Chung Trans
(74) *Attorney, Agent, or Firm* — Thorpe North & Western LLP

(57) ABSTRACT

A conductive gasket includes a deformable contact region configured to provide compressive contact between the mounting surface of a connector (e.g., a right-angle micro-D connector) and a grounded surface of the substrate (e.g., PCB). A fastener region extends from the deformable contact region and is configured to align with a mounting region of the connector. A keep-out zone is provided adjacent to the deformable contact region and the fastener region and is configured to allow the pins of the connector to pass therethrough.

20 Claims, 3 Drawing Sheets

METHODS AND APPARATUS FOR A GROUNDING GASKET

GOVERNMENT RIGHTS

This invention was made with United States Government support under Contract number FA8681-06-C-0152. The United States Government has certain rights in this invention.

TECHNICAL FIELD

The present invention generally relates to electronic interconnects, and more particularly relates to systems and methods for providing electrical continuity between connectors and their respective substrates.

BACKGROUND

Many connectors used in the electronics industry do not include built-in mechanisms for grounding the metal body of the connector to a printed circuit board (PCB). This is the case, for example, with right-angle connectors such as the well-known right-angle micro-D connector (MIL-DTL-83513/10-15). As shown in FIG. 1, the body of this type of connector typically includes a large plastic region 110 and a relatively small conductive region 108 adjacent to the mating face (102). The task then becomes grounding conductive region 108 to a grounded region on the underlying substrate or PCB.

Methods for grounding such connectors often include placing conductive polymeric pastes or gaskets between the connector body and the PCB. Gaskets used in connection with such methods, however, are usually undesirably thick and require pressure sensitive adhesive to keep them in place. These pressure-sensitive adhesives are known to deteriorate over time. Similarly, conductive pastes used to ground the connector may crack or chip away, leading to the introduction of debris into the system.

Accordingly, it is desirable to provide reliable and easy-to-install conductive caskets for establishing a ground path between connectors mounted on PCB boards and the like. Other desirable features and characteristics of the present invention will become apparent from the subsequent detailed description and the appended claims, taken in conjunction with the accompanying drawings and the foregoing technical field and background.

BRIEF SUMMARY

In accordance with one embodiment, a gasket includes: a deformable contact region configured to provide compressive contact between the mounting surface of the connector (e.g., a right-angle micro-D connector) and a grounded surface of the substrate (e.g., PCB), a fastener region extending from the deformable contact region and configured to align with a mounting region of the connector, and a keep-out zone adjacent to the deformable contact region and the fastener region, the keep-out zone configured to allow the pins of the connector to pass therethrough.

BRIEF DESCRIPTION OF THE DRAWINGS

A more complete understanding of the present invention may be derived by referring to the detailed description and claims when considered in conjunction with the following figures, wherein like reference numbers refer to similar elements throughout the figures.

DETAILED DESCRIPTION

The following discussion generally relates to methods and apparatus for a conductive gasket incorporating one or more fastener regions extending from a deformable contact region configured to be mounted between a connector and a PCB or other substrate. In that regard, the following detailed description is merely illustrative in nature and is not intended to limit the invention or the application and uses of the invention. Furthermore, there is no intention to be bound by any expressed or implied theory presented in the preceding technical field, background, brief summary or the following detailed description. For the purposes of conciseness, conventional techniques and principles related to electrical connectors, printed circuit boards, metal stamping, and the like need not, and are not, described in detail herein.

Figure 1:
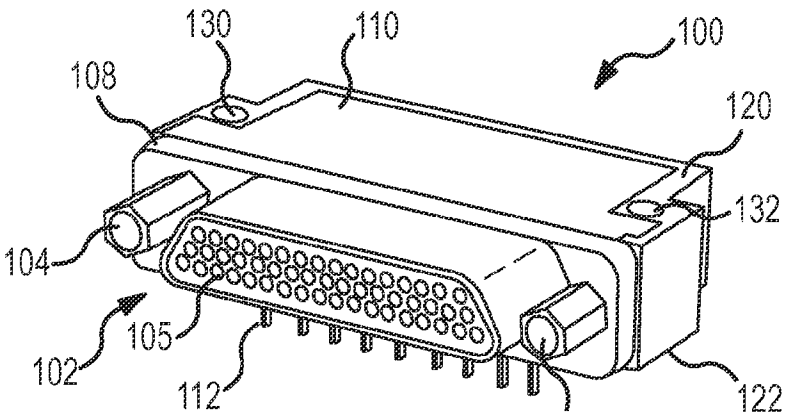
FIG.1 (PRIOR ART)
FIG. 1 is an isometric view of a standard micro-D connector.

FIG. 1 is an isometric overview of a typical right-angle micro-D connector 100 useful in describing the present invention. As a threshold matter, however, it will be understood that the invention may be used in conjunction with a variety of connector types, and is thus not limited to gaskets used with right-angle micro-D connectors.

As shown, connector 100 includes a mating face 102, having a cavity or "pin field" 105 containing pins configured to accept sockets from a mating connector component (not illustrated) and a bottom or "mounting surface" (or "face") 122. Mounting holes 130 and 132 extend through connector 100 from top surface 120 to mounting surface 122, and a pair of threaded connection posts (or "jack posts") 104 and 106 generally flank pin field 105.

Connector 100 includes an insulated (e.g., plastic) portion 110, and a conductive (e.g., metal) portion 108. A plurality of leads 112 extend normal to mounting surface 122. Thus, as pins 112 extend along an axis that is at a ninety degree angle with respect to the axis of mating face 102 (e.g., the direction of sockets inserted within pin field 105), connector 100 is generally referred to as a "right-angle" connector. Stated another way, the mating face 102 is orthogonal to mounting surface 122.

Figure 2:
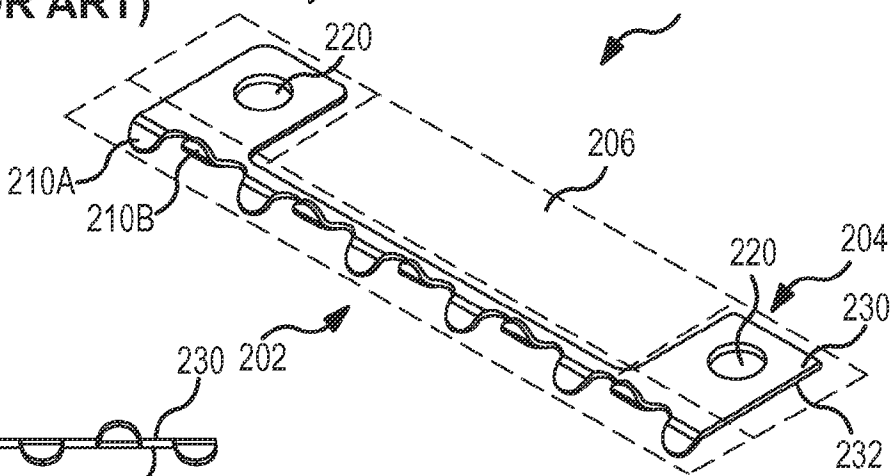
FIG. 2 is an isometric view of a gasket in accordance with one embodiment of the invention.
Figure 3:
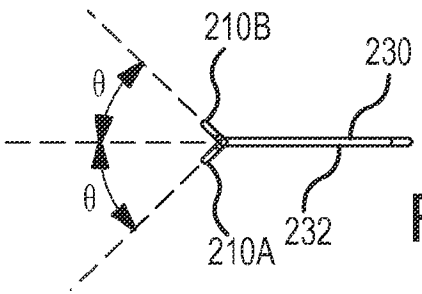
FIG. 3 is a side view of the gasket of FIG. 2.
Figure 4:
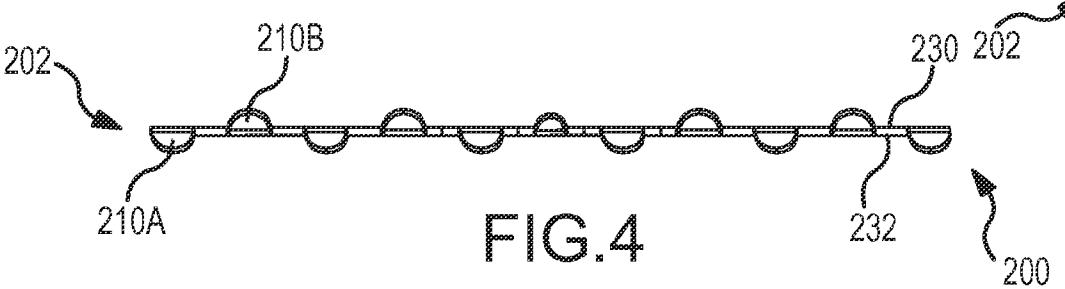
FIG. 4 is an end-view of the gasket of FIG. 2.

As mentioned above, it is desirable to provide electrical connectivity between the conductive portion 108 of connector 100 and a ground node, which will typically be provided on the substrate or PCB to which connector 100 is to be connected. Accordingly, FIGS. 2-4 depict isometric, side, and end-on views, respectively, of an exemplary gasket 200 configured to provide such connectivity.

In general, gasket 200 includes one or more fastener regions 204 extending from one or more deformable contact regions 202 such that a "keep-out zone" 206 is provided to allow any pins (as well as any solder pins, PC tails, or leads) to freely project therethrough. The keep-out zone may comprise a large open region as illustrated, a set of individual holes or openings that allow the respective pins to extend therethrough, or a combination thereof. Fastener regions 204 are configured to interface in some manner with connector 100 (e.g., via alignment with mounting holes 130 and 132, or via connection posts 106) such that gasket 200 can be secured in place with respect to connector 100.

In a micro-D application, for example, keep-out zone 206 is flanked by a pair of fastener regions 204 and respective mounting holes 220, both of which extend from opposite ends of deformable contact region 202. Alternatively, fastener regions may be configured to fasten to connection posts 106 of connector 100. Indeed, the present invention comprehends any suitable configuration of fastener regions 204, keep-out zone 206, and deformable contact region 202, which will vary depending upon the geometry of connector 100.

Figure 6:
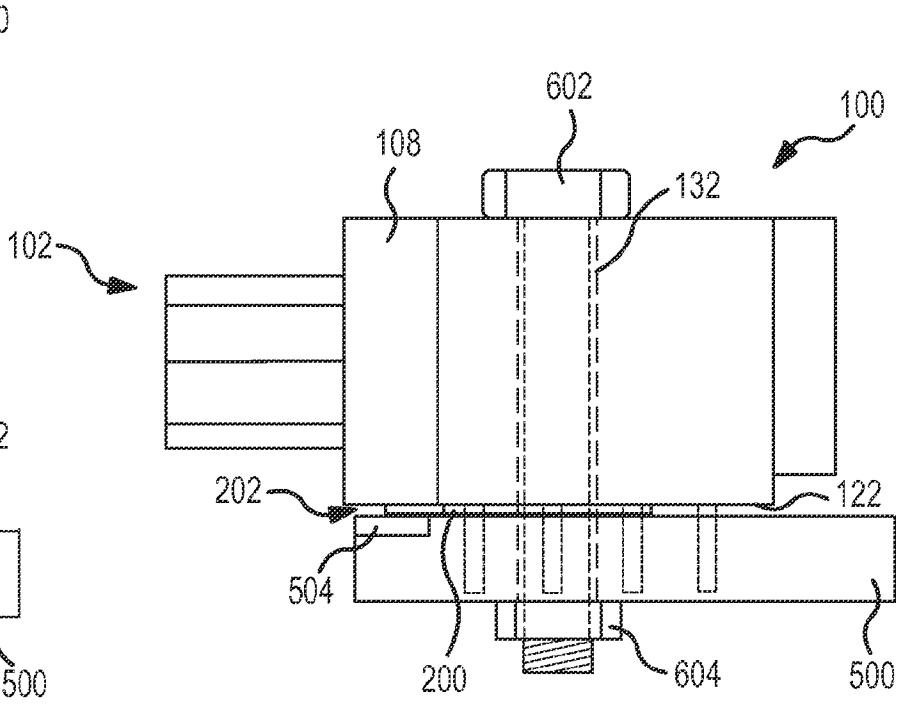
FIGS. 5 and 6 depict the installation of a gasket in accordance with one embodiment.
Figure 5:
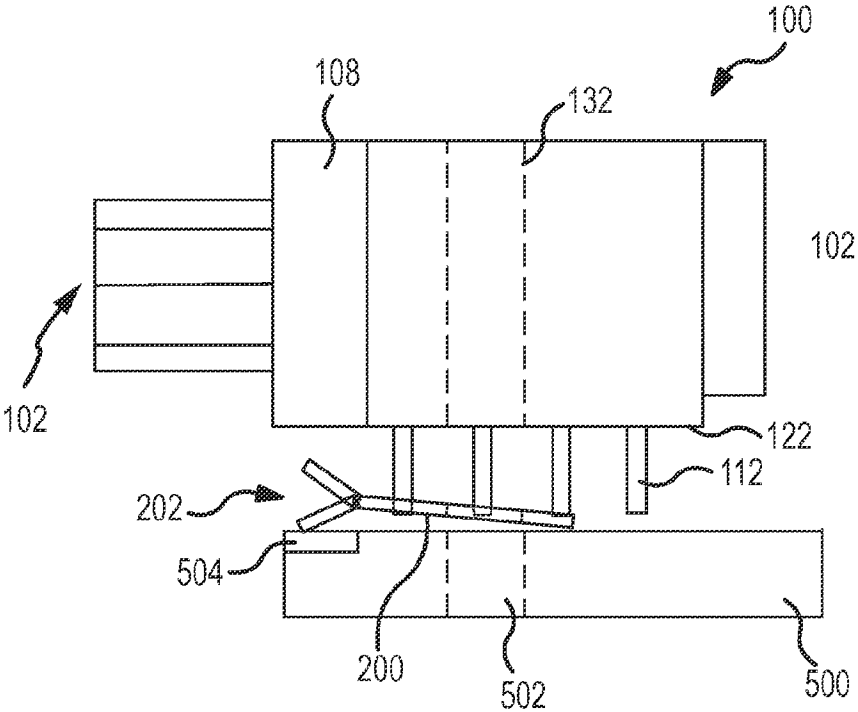

Deformable contact region 202 includes a plurality of deformable structures 210 configured to compressively contact conductive portion 108 of connector 100 and the underlying PCB. That is, with momentary reference to the side-view illustrations of FIGS. 5 and 6, gasket 200 is placed between connector 100 and a PCB 500 such that deformable contact region 202 contacts a grounded region 504 incorporated into PCB 500. When connector 100 is secured to PCB 500 (e.g., via a pair of screws 602 and respective nuts 605), deformable contact region 202 is compressed, providing electrical contact between conductive portion 108 of connector 100 and ground region 504. At the same time, pins 112 are allowed to project through substrate 500 in the "keep-out zone" 206 of gasket 200 (shown in FIG. 2).

Referring again to FIGS. 2-4. The nature and geometry of deformable structures 210 may vary, depending upon the desired mechanical and electrical characteristics. In the illustrated embodiment, deformable structures 210A, 210B, etc., include generally curvilinear tabs projecting outward at alternating angles (e.g., angles of −45.0 and 45.0 degrees with respect to the plane defined by gasket 200 in the illustrated embodiment). In this way, when compressed, tab 210A will contact the appropriate ground contact on the PCB, and tab 210B will contact conductive portion 108 of connector 100. As shown, the structures 210 may consist of generally semi-circular shapes separated by a similarly proportioned semi-circular regions. However, any suitable shape and angle may be used.

Figure 8:
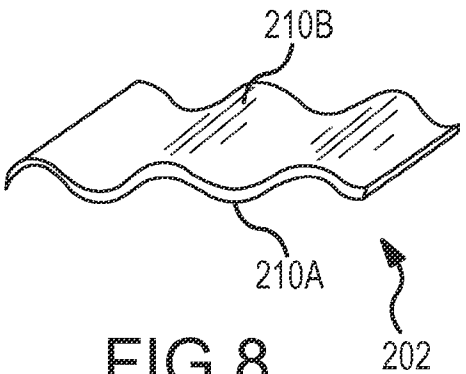
FIGS. 8 and 9 depict example deformable contact regions in accordance with various alternate embodiments.
Figure 9:
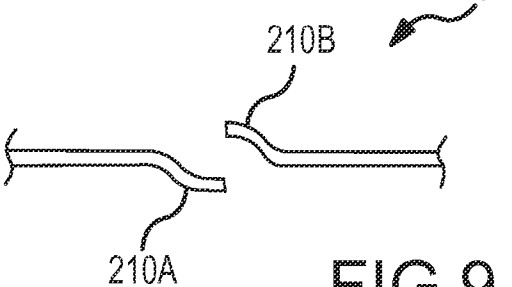

Furthermore, a wide variety of deformable structures 210 may employed. FIGS. 8 and 9, for example, show alternate embodiments that may be applicable in particular context. In FIG. 8, the deformable structures 210A and 210B consist of the peaks and valleys of an elongated strip having a generally sinusoidal cross-sectional region 202. In FIG. 9, deformable structures 210A and 210B consist of spring like "fingers" projecting downward and upward, respectively.

Referring again to FIGS. 2-4, the thickness and size of gasket 200 may be selected based on the geometry of connector 100 and any other applicable design objectives. In one embodiment, gasket 200 has a thickness of approximately 0.010 inches thick, a total front view width of about 1.325 inches, and a side view depth of about 0.350 inches. It will be appreciated that it is desirable for these dimensions to substantially conform to those of connector 100. Thus, for example, in a preferred embodiment the distance between mounting holes 220 is approximately 1.115 inches, as specified in the micro-D specification.

Gasket 200 may comprise any suitable material or combination of materials. It is desirable for gasket 200 to exhibit a relatively high electrical conductivity, at the same time having mechanical properties that allow it to deform elastically and thus provide sufficient compressive contact with connector 100 and PCB 500. Toward this end, in one embodiment, gasket 200 comprises a conventional steel, such as stainless steel. In an alternate embodiment, gasket 200 comprises a Be—Cu alloy, C50500, Alloy 165, C17500, or C17510.

Figure 7:
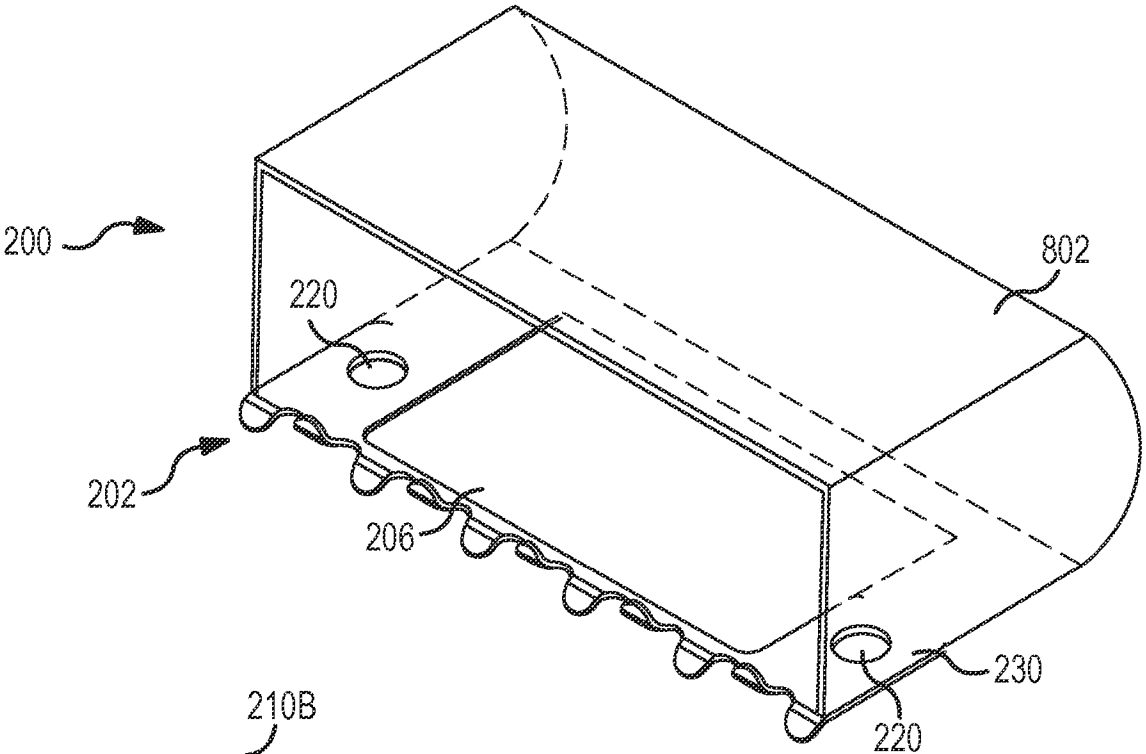
FIG. 7 depicts an alternate embodiment of a gasket incorporating an EMI shield.

In a further embodiment, as illustrated conceptually in FIG. 7, an electromagnetic interference (EMI) shield or "back-shell" 802 is incorporated into gasket 200. That is, shield 802 consists of a structure and material (e.g., a conductive metal) allowing it to act as a "Faraday cage" or the like, thereby shielding connector 100 from any such interference.

While at least one example embodiment has been presented in the foregoing detailed description, it should be appreciated that a vast number of variations exist. It should also be appreciated that the example embodiment or embodiments described herein are not intended to limit the scope, applicability, or configuration of the invention in any way. Rather, the foregoing detailed description will provide those skilled in the art with a convenient and edifying road map for implementing the described embodiment or embodiments. It should be understood that various changes can be made in the function and arrangement of elements without departing from the scope of the invention and the legal equivalents thereof.

What is claimed is:

1. A gasket for providing electrical connectivity between a substrate and a connector having a plurality of pins extending from a mounting surface, the gasket comprising:

a deformable contact region configured to provide compressive contact between the mounting surface of the connector and a grounded surface of the substrate;

a fastener region extending from the deformable contact region and configured to align with a mounting region of the connector;

a keep-out zone adjacent to the deformable contact region or the fastener region, the keep-out zone configured to allow the pins of the connector to pass therethrough.

2. The gasket of claim 1, wherein the fastener region is configured to align with a pair of mounting holes incorporated into the connector.

3. The gasket of claim 2, wherein the deformable contact region is configured to provide the compressive contact when a fastener is affixed through the mounting holes.

4. The gasket of claim 1, wherein the fastener region is configured to align with two or more connector structures provided on a mating face of the connector.

5. The gasket of claim 1, wherein the keep-out zone is a generally rectangular region configured to allow the pins of a micro-D connector to extend therethrough.

6. The gasket of claim 1, wherein the deformable contact region provides compressive contact between a conductive portion of the connector that is adjacent to a mating face of the connector.

7. The gasket of claim 1, wherein the deformable contact region comprises a material selected from the group consisting of steel, phos-bronze, and a copper-beryllium alloy.

8. The gasket of claim 1, wherein the connector is a right-angle micro-D connector.

9. The gasket of claim 1, further including an electromagnetic interference shield integral with the fastener region and configured to substantially encapsulate the connector.

10. The gasket of claim 1, wherein the deformable contact region includes a plurality of deformable structures.

11. The gasket of claim 10, wherein a portion of the plurality of deformable structures are generally angled at a predetermined angle $\Theta$ with respect to a plane of the gasket, and a portion of the plurality of deformable structures are generally angled at an angle of $-\Theta$ with respect to the plane of the gasket.

12. The gasket of claim 10, wherein the plurality of deformable structures include generally semicircular structures.

13. The gasket of claim 10, wherein the plurality of deformable structures include two or more elastic fingers projecting from the deformable contact region.

14. A method of providing a ground path between a connector and a grounded region on a printed circuit board, comprising:

providing a gasket having a deformable contact region, a fastener region extending from the deformable contact region, and a keep-out zone adjacent to the deformable contact region and the fastener region;

placing the gasket adjacent the printed circuit board such that the deformable contact region is aligned with the grounded region;

placing the connector adjacent the gasket such that the deformable contact region is aligned with a conductive portion of the connector and between the conductive portion of the connector and the grounded region of the printed circuit board, one or more mounting features of the connector are aligned with the fastener region, and one or more pins of the connector extend through the keep-out zone.

15. The method of claim 14, wherein providing the gasket includes providing a plurality of deformable structures in the deformable contact region.

16. The method of claim 14, wherein providing a gasket includes providing a thin layer of conductive material, and stamping the thin layer of conductive material to form the deformable contact region, the keep-out zone, and the fastener region.

17. The method of claim 14, wherein the step of placing a connector includes placing a right-angle micro-D connector.

18. A gasket for coupling a body of a connector to a grounded region of a printed circuit board, wherein the connector has one or more mounting holes, a mounting face, a mating face generally orthogonal to the mounting face, and plurality of pins extending from the mounting face, the gasket comprising:

a deformable contact region including a plurality of deformable structures aligned with a conductive portion of the body of the connector to provide contact between the conductive portion of the connector and the grounded region of the printed circuit board;

a fastener region extending from the deformable contact region and configured to align with a mounting holes of the body of the connector;

a keep-out zone adjacent to the deformable contact region and the fastener region, the keep-out zone configured to allow the pins of the connector to pass therethrough.

19. The gasket of claim 18, further including an electromagnetic interference shield integral with the fastener region and configured to substantially surround the body of the connector.

20. The gasket of claim 18, wherein the deformable contact region, the fastener region, and keep-out zone are configured to correspond, respectively, to the conductive portion, the mounting holes, and the pins of a right-angle micro-D connector.

* * * * *